US011756398B2

(12) United States Patent
Colaluca et al.

(10) Patent No.: US 11,756,398 B2
(45) Date of Patent: Sep. 12, 2023

(54) METHODS AND APPARATUSES FOR REDUCING FALSE POSITIVE ALARMS

(71) Applicant: Sensormatic Electronics, LLC, Boca Raton, FL (US)

(72) Inventors: Gregory Colaluca, Allen, TX (US); Eric Reich, Howell, NJ (US); Luis Tiago Bola Lagarto, Leça da Palmeira (PT); Hugo Manuel Costa Ribeiro, Sandim (PT); João Carlos Veríssimo Costa Teixeira De Sousa, Maia (PT); Bruno Miguel Rodrigues Costa Moura, Arada (PT); Wilson Fernandes Carvalho Pinto De Oliveira, Santa Maria da Feira (PT); Chad M. Gundlach, Ladera Ranch, CA (US); Yosbi Antonio Alves Saenz, Perosinho (PT); Leandro André Azevedo Soares, Esmoriz (PT)

(73) Assignee: Sensormatic Electronics, LLC, Boca Raton, FL (US)

( * ) Notice: Subject to any disclaimer, the term of this patent is extended or adjusted under 35 U.S.C. 154(b) by 0 days.

(21) Appl. No.: 17/205,914

(22) Filed: Mar. 18, 2021

(65) Prior Publication Data

US 2022/0301404 A1 Sep. 22, 2022

(51) Int. Cl.
*G08B 13/24* (2006.01)
*G08B 29/18* (2006.01)

(52) U.S. Cl.
CPC ..... *G08B 13/2482* (2013.01); *G08B 13/2462* (2013.01); *G08B 13/2485* (2013.01); *G08B 29/185* (2013.01)

(58) Field of Classification Search
CPC ..... G08B 13/2482; G08B 13/2462; G08B 29/185
See application file for complete search history.

(56) References Cited

U.S. PATENT DOCUMENTS

| | | | | |
|---|---|---|---|---|
| 2003/0214387 | A1* | 11/2003 | Giaccherini | G08B 13/2417 340/8.1 |
| 2012/0161968 | A1* | 6/2012 | Bodapati | G08B 13/2485 340/572.1 |
| 2017/0063476 | A1* | 3/2017 | Nair | G06K 7/10475 |
| 2019/0130714 | A1* | 5/2019 | Miettinen | G08B 13/2417 |

* cited by examiner

*Primary Examiner* — Andrew W Bee
(74) *Attorney, Agent, or Firm* — ARENTFOX SCHIFF LLP

(57) ABSTRACT

Aspects of the present disclosure include methods, systems, and non-transitory computer readable media for identifying a first sector proximal to a reader and a second sector proximal to the reader, receiving one or more parameters associated with at least one of a minimum sector count setting, an opposite sector threshold setting, or a suppression threshold setting, applying, to the reader, the one or more parameters associated with the at least one of the minimum sector count setting, the opposite sector threshold setting, or the suppression threshold setting, and detecting a tag based on the one or more parameters.

9 Claims, 3 Drawing Sheets

METHODS AND APPARATUSES FOR REDUCING FALSE POSITIVE ALARMS

BACKGROUND

A retail store may encounter loss due to theft. For example, a thief may remove a merchandize item from the retail store without proper payment. To reduce theft, the retail store my rely on an electronic article surveillance (EAS) system to deter and/or detect the thief. The EAS system may include a reader and one or more tags attached to items of merchandize. When the reader detects the one or more tags being removed from the retail store without proper payment of the attached items of merchandize, the reader may trigger an alarm to notify staff of the retail store. However, the reader may trigger false positive alarms that may disrupt operations of the retail store, increase cost, and/or negatively impact customer relations. Therefore, it would be desirable to reduce the number of false positive alarms.

SUMMARY

This summary is provided to introduce a selection of concepts in a simplified form that are further described below in the DETAILED DESCRIPTION. This summary is not intended to identify key features of the claimed subject matter, nor is it intended to be used as an aid in determining the scope of the claimed subject matter.

Aspects of the present disclosure include methods, systems, and/or computer readable media for identifying a first sector proximal to a reader and a second sector proximal to the reader, receiving one or more parameters associated with at least one of a minimum sector count setting, an opposite sector threshold setting, or a suppression threshold setting, applying, to the reader, the one or more parameters associated with the at least one of the minimum sector count setting, the opposite sector threshold setting, or the suppression threshold setting, determining whether a tag has moved from the first sector to the second sector based on the one or more parameters, and transmitting an alarm signal in response to the tag moving from the first sector to the second sector or refraining from transmitting a false alarm signal in response to the tag not moving.

BRIEF DESCRIPTION OF THE DRAWINGS

The features believed to be characteristic of aspects of the disclosure are set forth in the appended claims. In the description that follows, like parts are marked throughout the specification and drawings with the same numerals, respectively. The drawing figures are not necessarily drawn to scale and certain figures may be shown in exaggerated or generalized form in the interest of clarity and conciseness. The disclosure itself, however, as well as a preferred mode of use, further objects and advantages thereof, will be best understood by reference to the following detailed description of illustrative aspects of the disclosure when read in conjunction with the accompanying drawings, wherein:

DETAILED DESCRIPTION

The following includes definitions of selected terms employed herein. The definitions include various examples and/or forms of components that fall within the scope of a term and that may be used for implementation. The examples are not intended to be limiting.

An aspect of the present disclosure may include techniques for reducing the number of false positive alarms in an electronic article surveillance (EAS) system. The EAS system may include one or more readers and one or more tags. The one or more tags may be attached to one or more items of merchandize. The one or more readers may be configured to detect the one or more tags in a number of sectors. For example, each reader may be configured to detect the one or more tags in a sector. In another example, each reader may include antennas that each detect the one or more tags in a respective sector. Each of the one or more readers may include one or more antennas configured to acquire one or more tag reads from each of the one or more tags. A tag read from a tag may include the one or more readers transmitting an interrogating signal to the tag and/or receiving a response signal from the tag. The one or more readers may determine a presence, a location, tag information, product information, or other information associated with the tag and/or the item of merchandize attached to the tag.

In a first aspect, a reader of the EAS system may determine that a tag is in a sector after acquiring two or more consecutive tag reads indicating that the tag is in the sector. In a second aspect, if a reader acquires two or more consecutive tag reads indicating that the tag is in a sector, the reader may lower the rank (e.g., weight of a tag read when determining whether the tag is in a sector) of neighboring sectors of the sector. In a third aspect, a reader may determine the tag is in motion based on detecting a change in the received signal strength indicators of two or more tag reads being greater than a threshold.

Figure 1:
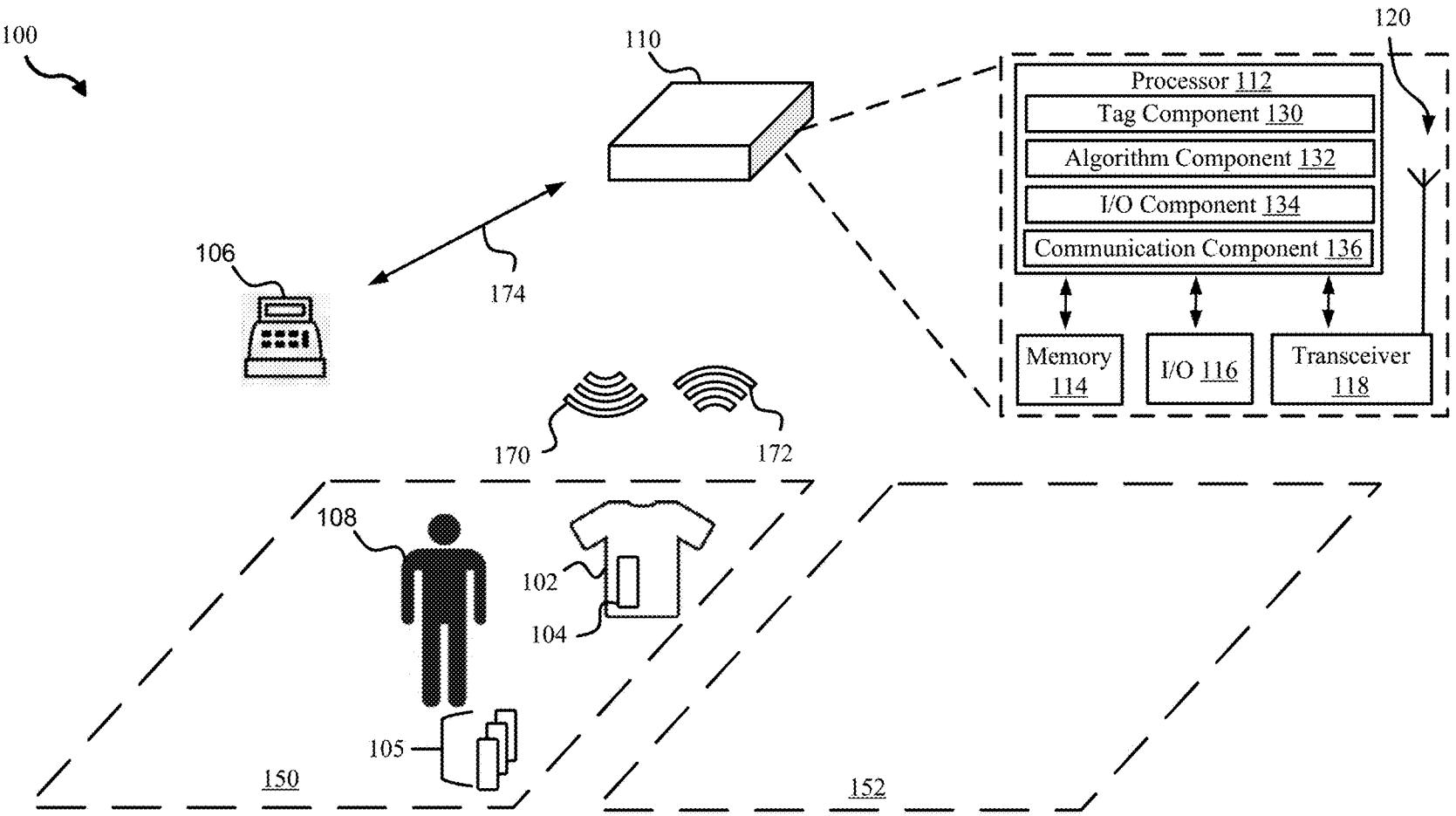
FIG. 1 illustrates an example of an environment for reducing false positive alarms in accordance with aspects of the present disclosure.

Referring to FIG. 1, in a non-limiting implementation, an example of an environment 100 (e.g., a retail store) may include an item of merchandize 102 having a tag 104 attached. The environment 100 may include one or more peripheral tags 105. The environment 100 may include a cash register 106 for handling purchase transactions associated with the item of merchandize 102 (e.g., receiving payments for the item of merchandize 102, updating the status of the tag 104 after purchase). Alternatively, the cash register 106 may be a kiosk. The environment may include a reader 110 for detecting the tags 104, 105 and/or reading information from the tags 104, 105. The reader 110, the tag 104, the peripheral tags 105 may be part of an EAS system, such as an electro-magnetic (EM) system, an acousto-magnetic (AM) system, a radio frequency identification (RFID) system, a microwave system, or a quadrature resonance system. The reader 110 may be an EM reader, an AM reader, a RFID reader, a microwave reader, or a quadrature resonance reader.

In one aspect, the reader 110 may be placed at an entrance/exit of the retail store. The reader 110 may identify a first sector 150 (inside the retail store) and a second sector 152 (outside the retail store). The reader 110 may identify the first sector 150 and the second sector 152 based on the configurations and/or placements of the one or more antennas 120. The reader 110 may be programmed to identify the first sector 150 and the second sector 152.

In some implementations, the reader 110 may be configured to acquire tag reads from tags in the first sector 150 and the second sector 152. For example, the reader 110 may be configured to detect the tag 104 in the first sector 150 at time t and the tag 104 in the second sector 152 at time $t+t_0$. Based on the detection above, the reader 110 may be able to determine that the tag 104 has moved (e.g., being attached to the item of merchandize 102 carried by a customer 108) from the first sector 150 to the second sector 152.

In some aspects, the reader 110 may include a processor 112 and a memory 114. The processor 112 may be configured to execute the instructions stored in the memory 114 to implement the techniques described in the current application.

The term "processor," as used herein, can refer to a device that processes signals and performs general computing and arithmetic functions. Signals processed by the processor can include digital signals, data signals, computer instructions, processor instructions, messages, a bit, a bit stream, or other computing that can be received, transmitted and/or detected. A processor, for example, can include microprocessors, microcontrollers, digital signal processors (DSPs), field programmable gate arrays (FPGAs), programmable logic devices (PLDs), state machines, gated logic, discrete hardware circuits, and other suitable hardware configured to perform the various functionality described herein. The term "memory," as used herein, can include volatile memory and/or nonvolatile memory. Non-volatile memory can include, for example, ROM (read only memory), PROM (programmable read only memory), EPROM (erasable PROM) and EEPROM (electrically erasable PROM). Volatile memory can include, for example, RAM (random access memory), synchronous RAM (SRAM), dynamic RAM (DRAM), synchronous DRAM (SDRAM), double data rate SDRAM (DDR SDRAM), and direct RAM bus RAM (DRRAM).

The term "memory," as used herein, can include volatile memory and/or nonvolatile memory. Non-volatile memory can include, for example, ROM (read only memory), PROM (programmable read only memory), EPROM (erasable PROM) and EEPROM (electrically erasable PROM). Volatile memory can include, for example, RAM (random access memory), synchronous RAM (SRAM), dynamic RAM (DRAM), synchronous DRAM (SDRAM), double data rate SDRAM (DDR SDRAM), and direct RAM bus RAM (DRRAM).

In one aspect, the reader 110 may include input/output (I/O) 116 configured to receive configuration and/or setting information associated with techniques for reducing false positive alarms. The I/O 116 may be configured to broadcast an audio alarm and/or display visual alarm. In certain examples, the I/O 116 may include knobs, alpha-numeric keys, buttons, or other controls for input. The I/O 116 may include strobe lights, light emitting diodes (LEDs), displays, siren, or other devices for output. The I/O 116 may include devices and/or interfaces for receiving indication signals from the processor 112.

In some aspects, the reader 110 may include a transceiver 118 and/or one or more antennas 120 configured to transmit one or more interrogating signals 170 to the tag 104. The transceiver 118 and/or the one or more antennas 120 may be configured to receive one or more response signals 172 from the tag 104. The one or more response signals 172 may include information associated the tag 104 and/or information associated with the item of merchandize 102. The reader 110 may acquire one or more tag reads based on the one or more response signals 172. Based on the one or more tag reads, the reader 110 may obtain the information associated with the tag 104 and/or the item of merchandize 102, the position of the tag 104 (e.g., distance from the reader 102), and/or other information. The position of the tag 104 may be computed by the reader 110 based on known methods.

In certain aspects, the processor 112 of the reader 110 may include one or more components implemented as hardware, software, or a combination thereof. For example, the processor 112 may include a tag component 130 configured to detect the tag 104 based on the signals received from the tag 104. The processor 112 may include an algorithm component 132 configured to implement techniques used for reducing false positive detections. The processor 112 may include an I/O component 134 configured to receive input signals from the I/O 116 and/or send output signals to the to the I/O 116. The processor 112 may include a communication component 136 configured to receive signals from the cash register 106 and/or transmit signals to the cash register 106.

During operation, in one implementation, a customer 108 may purchase the item of merchandize 102 at the cash register 106. After proper payment, the cash register 106 may transmit a signal via a communication link 174 to the reader 110 indicating that the item of merchandize 102 has been paid in full. The customer 108 may carry the item of merchandize 102 and the attached tag 104 while moving from the first sector 150 (inside the retail store) to the second sector 152 (outside the retail store). The reader 110 may detect the tag 104 in the first sector 150 at t and in the second sector 152 at $t+t_0$. Based on the detection above, the reader 110 may determine that tag 104, and consequently, the item of merchandize 102, are leaving the environment 100. Since the reader 110 received indication that the item of merchandize 102 has been paid in full, the customer 108 may remove the item of merchandize 102 from the environment 100 without triggering an alarm. Alternatively or additionally, the cash register 106 may disable the tag 104 to allow the customer 108 to remove the item of merchandize 102 from the environment 100. Alternatively or additionally, the cash register 106 may update the information in the tag 104 to indicate to the reader 110 (during the tag read) that the item of merchandize 102 has been properly purchased.

In some instances, the reader 110 may acquire tag reads from the one or more peripheral tags 105. While the one or more peripheral tags 105 may be stationary in the first sector 150, the reader 110 may acquire a first tag read indicating that the one or more peripheral tags 105 is in the first sector 150 at $t_1$. Due to interferences, reflections, noises, or other factors (e.g., a person walking by the one or more peripheral tags 105, an external device transmitting signals), the reader 110 may acquire a second tag read incorrectly indicating that the one or more peripheral tags 105 is in the second sector 152 at $t_1+t_2$, even though the one or more peripheral tags 105 remains stationary between $t_1$ and $t_1+t_2$. As such, the reader 110 may trigger an alarm due to a false positive detection.

In a first aspect of the present disclosure, a reader may determine that a tag is in a sector after acquiring two or more consecutive tag reads indicating that the tag is in the sector. In one example, the reader 110 may be programmed to determine that a tag is in a sector after acquiring two consecutive tag reads indicating that the tag is in the sector. An authorized personnel (not shown) may input the parameters associated with the configuration and/or setting for reducing false positive alarms via the I/O 116. Alternatively, the reader 110 may load the parameters from the memory 114, receive the parameters via a wired and/or wireless link, and/or receive the parameters via the transceiver 118 and/or the one or more antennas 120.

In some instances, the reader 110 may acquire five tag reads from the one or more peripheral tags 105. The first four of the five tag reads may indicate that the one or more peripheral tags 105 is in the first sector 150 and the fifth tag read may indicate that the one or more peripheral tags 105 is in the second sector 152. However, since only one tag read indicates that the one or more peripheral tags 105 is in the second sector 152, the processor 112, the tag component 130 and/or the algorithm component 132 of the reader 110 may determine that the one or more peripheral tags 105 remains in the first sector 150 after the fifth tag read. As a result, the reader 110 may refrain from triggering an alarm because only one tag read (i.e., the fifth tag read) indicates that the one or more peripheral tags 105 is in the second sector 152, and therefore, the one or more peripheral tags 105 (and/or the items of merchandized attached) has not been removed from the environment 100. The fifth tag read may not trigger an alarm because two or more reads are necessary for triggering the alarm. The reader 110 may consider the fifth tag read (alone) as a false alarm due to effects described above (e.g., interference, reflections, noises . . . ).

In another example, the reader 110 may be programmed to determine that a tag is in a sector after acquiring three consecutive tag reads indicating that the tag is in the sector. An authorized personnel (not shown) may input the parameters associated with the configuration and/or setting for reducing false positive alarms via the I/O 116. Alternatively, the reader 110 may load the parameters from the memory 114, receive the parameters via a wired and/or wireless link, and/or receive the parameters via the transceiver 118 and/or the one or more antennas 120. The reader 110 may acquire six tag reads from the one or more peripheral tags 105. The first three tag reads of the six tag reads may indicate that the one or more peripheral tags 105 is in the first sector 150 and the last three tag reads may indicate that the one or more peripheral tags 105 is in the second sector 152. Since three tag reads indicate that the one or more peripheral tags 105 is in the second sector 152, the processor 112, the tag component 130 and/or the algorithm component 132 of the reader 110 may determine that the one or more peripheral tags 105 has moved from the first sector 150 to the second sector 152. As a result, the reader 110 may trigger an alarm indicating that the one or more peripheral tags 105 (and/or the items of merchandized attached) has been removed from the environment 100.

In some aspects, the reader 110 may transmit an alarm signal to an alarm (not shown) to trigger the alarm. The alarm may include a visual alarm or an audio alarm. Examples of the alarm may include a text message to a security guard, or an indication signal to one or more of a siren, a strobe light, a display, or other suitable devices. In certain implementations, the reader 110 may transmit an alarm signal to one or more security staffs of the environment 100 to indicate that items of merchandizes have been remove without proper payment. In some aspects, the reader 110 may refrain from trigger a false alarm by refraining from transmitting a false alarm signal.

In a second aspect, if a reader acquires two or more consecutive tag reads indicating that the tag is in a sector, the reader may lower the rank (e.g., weight) of neighboring sectors of the sector. The reader 110 may determine that a tag having more than two consecutive tag reads in a sector has a higher probability of being in the sector than a neighboring sector based on a single tag read. In one example, the reader 110 may be programmed to lower the rank of the second sector 152 after acquiring two consecutive tag reads indicating that the one or more peripheral tags 105 is in the first sector 150. An authorized personnel (not shown) may input the parameters associated with the configuration and/or setting for reducing false positive alarms via the I/O 116. Alternatively, the reader 110 may load the parameters from the memory 114, receive the parameters via a wired and/or wireless link, and/or receive the parameters via the transceiver 118 and/or the one or more antennas 120. The reader 110 may acquire four tag reads from the one or more peripheral tags 105. The first three tag reads of the four tag reads may indicate that the one or more peripheral tags 105 is in the first sector 150. As a result, the processor 112, the tag component 130 and/or the algorithm component 132 of the reader 110 may lower the rank of the second sector 152. The fourth tag read of the four tag reads may indicate that the one or more peripheral tags 105 is in the second sector 152. However, since the rank of the second sector 152 has been lowered, the processor 112, the tag component 130 and/or the algorithm component 132 of the reader 110 may determine that the one or more peripheral tags 105 remains in the first sector 150 after the fourth tag read. As a result, the reader 110 may refrain from triggering a false alarm.

In a third aspect, a reader may determine the tag is in motion by detecting a change in the received signal strength indicators (RSSIs) of two or more tag reads being greater than (or greater than or equal to) a threshold. The reader 110 may For example, the reader 110 may be programmed with a threshold of 1 decibel-milliwatt (dBm). An authorized personnel (not shown) may input the parameters associated with the configuration and/or setting for reducing false positive alarms via the I/O 116. Alternatively, the reader 110 may load the parameters from the memory 114, receive the parameters via a wired and/or wireless link, and/or receive the parameters via the transceiver 118 and/or the one or more antennas 120. In one instance, the reader 110 may be preset with the threshold. The reader 110 may acquire nine tag reads from the one or more peripheral tags 105. The tag component 130, the algorithm component 132, the transceiver 118, of the reader 110 may determine that the RSSI of the third tag read (or the RSSI of the response signals associated with the third tag read) may be 0.7 dBm and the RSSI of the fourth tag read (or the RSSI of the response signals associated with the fourth tag read) may be 1.8 dBm. The change in the RSSIs is 1.1 dBm, which is greater than the threshold of 1 dBm. As a result, tag component 130 and/or the algorithm component 132 of the reader 110 may determine that the one or more peripheral tags 105 is in motion. If the reader 110 detects the one or more peripheral tags 105 moving beyond the entrance/exit, the reader 110 may trigger an alarm.

In some implementations, the reader 110 may implement the first aspect, the second aspect, or the third aspect described above. In other implementations, the reader 110 may implement any combination of the first aspect, the second aspect, and the third aspect described above.

Figure 2:
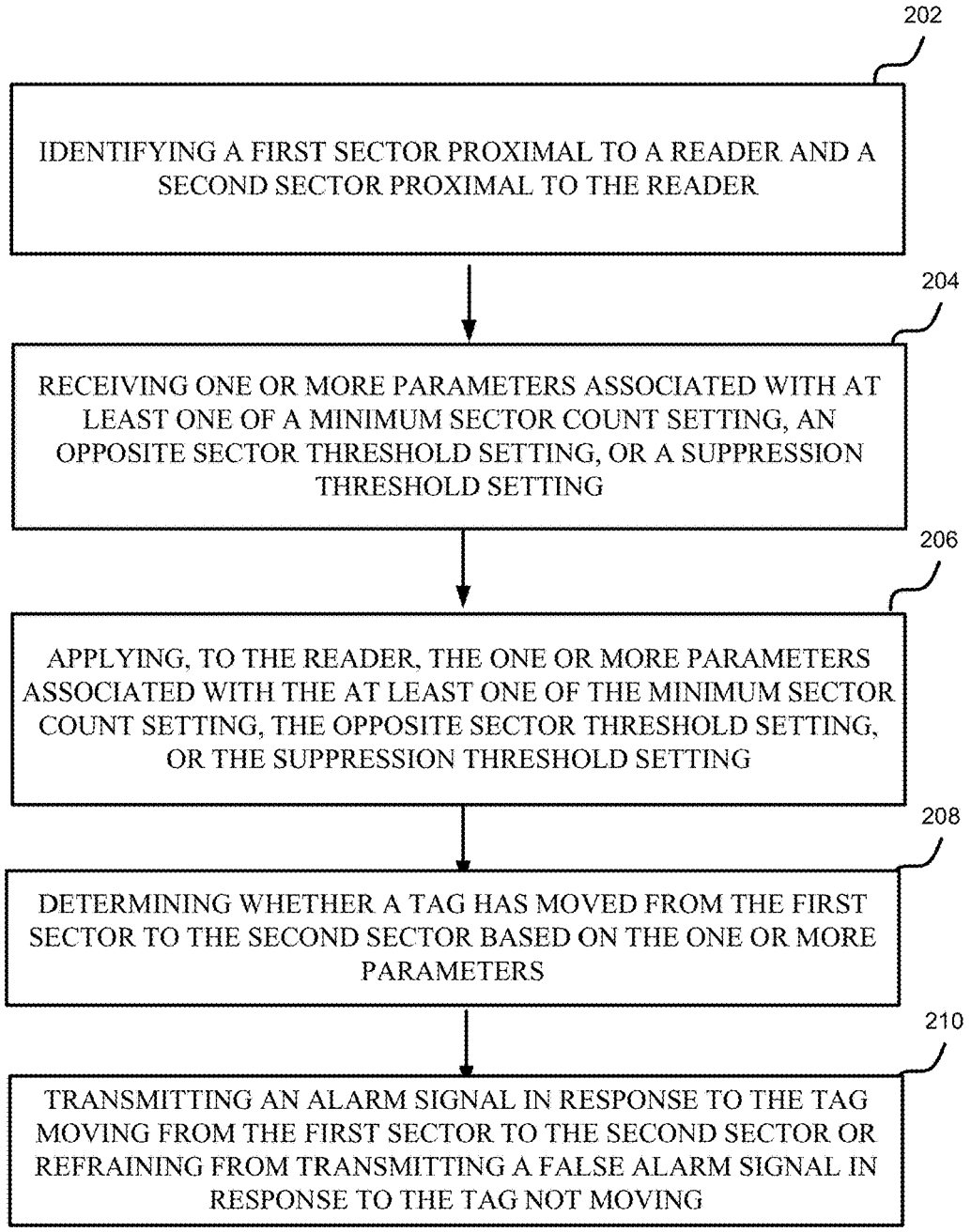
FIG. 2 illustrates an example of a method for reducing false positive alarms in accordance with aspects of the present disclosure.

Turning to FIG. 2, an example of a method 200 for reducing false positive alarms. Specifically, the method 200 may be performed by one or more of the processor 112, the tag component 130, the algorithm component 132, the I/O component 134, the communication component 136, the memory 114, the I/O 116, the transceiver 118, and/or the one or more antennas 120 of the reader 110.

At block 202, the method 200 may identify a first sector proximal to a reader and a second sector proximal to the reader. For example, the processor 112, the tag component 130, the memory 114, the I/O 116, the transceiver 118, and/or the one or more antennas 120 of the reader 110 may identify a first sector proximal to a reader and a second sector proximal to the reader as described above. The processor 112, the tag component 130, the memory 114, the I/O 116, the transceiver 118, and/or the one or more antennas 120 of the reader 110 may be configured to and/or define means for identifying a first sector proximal to a reader and a second sector proximal to the reader.

At block 204, the method 200 may receive one or more parameters associated with at least one of a minimum sector count setting, an opposite sector threshold setting, or a suppression threshold setting. For example, the processor 112, the tag component 130, the algorithm component 132, the I/O component 134, the communication component 136, the memory 114, and/or the I/O 116 may receive one or more parameters associated with at least one of a minimum sector count setting, an opposite sector threshold setting, or a suppression threshold setting as described above. The processor 112, the tag component 130, the algorithm component 132, the I/O component 134, the communication component 136, the memory 114, and/or the I/O 116 may be configured to and/or define means for receiving one or more parameters associated with at least one of a minimum sector count setting, an opposite sector threshold setting, or a suppression threshold setting.

At block 206, the method 200 may apply, to the reader, the one or more parameters associated with the at least one of the minimum sector count setting, the opposite sector threshold setting, or the suppression threshold setting. For example, the processor 112, the tag component 130 and/or the algorithm component 132 of the reader 110 may apply, to the reader, the one or more parameters associated with the at least one of the minimum sector count setting, the opposite sector threshold setting, or the suppression threshold setting as described above. The processor 112, the tag component 130 and/or the algorithm component 132 of the reader 110 may be configured to and/or define means for applying, to the reader, the one or more parameters associated with the at least one of the minimum sector count setting, the opposite sector threshold setting, or the suppression threshold setting.

In a first aspect, the reader 110 may determine that the one or more peripheral tags 105 is in a sector after acquiring two or more consecutive tag reads indicating that the tag is in the sector. In a second aspect, if the reader 110 acquires two or more consecutive tag reads indicating that the one or more peripheral tags 105 is in a sector, the reader 110 may lower the rank (e.g., weight) of neighboring sectors of the sector. In a third aspect, the reader 110 may determine the one or more peripheral tags 105 is in motion based on detecting a change in the received signal strength indicators of two or more tag reads being greater than a threshold.

At block 208, the method 200 may determine whether a tag has moved from the first sector to the second sector based on the one or more parameters. For example, the processor 112, the tag component 130, the algorithm component 132, the transceiver 118, and/or the one or more antennas 120 of the reader 110 may determine whether a tag has moved from the first sector to the second sector based on the one or more parameters. The processor 112, the tag component 130, the algorithm component 132, the transceiver 118, and/or the one or more antennas 120 of the reader 110 may be configured to and/or define means for determining whether a tag has moved from the first sector to the second sector based on the one or more parameters.

At block 210, the method 200 may transmit an alarm signal in response to the tag moving from the first sector to the second sector or refraining from transmitting a false alarm signal in response to the tag not moving. For example, the processor 112, the tag component 130, and/or the algorithm component 132 of the reader 110 may transmit an alarm signal in response to the tag moving from the first sector to the second sector or refraining from transmitting a false alarm signal in response to the tag not moving. The processor 112, the tag component 130, and/or the algorithm component 132 of the reader 110 may be configured to and/or define means for transmitting an alarm signal in response to the tag moving from the first sector to the second sector or refraining from transmitting a false alarm signal in response to the tag not moving.

Figure 3:
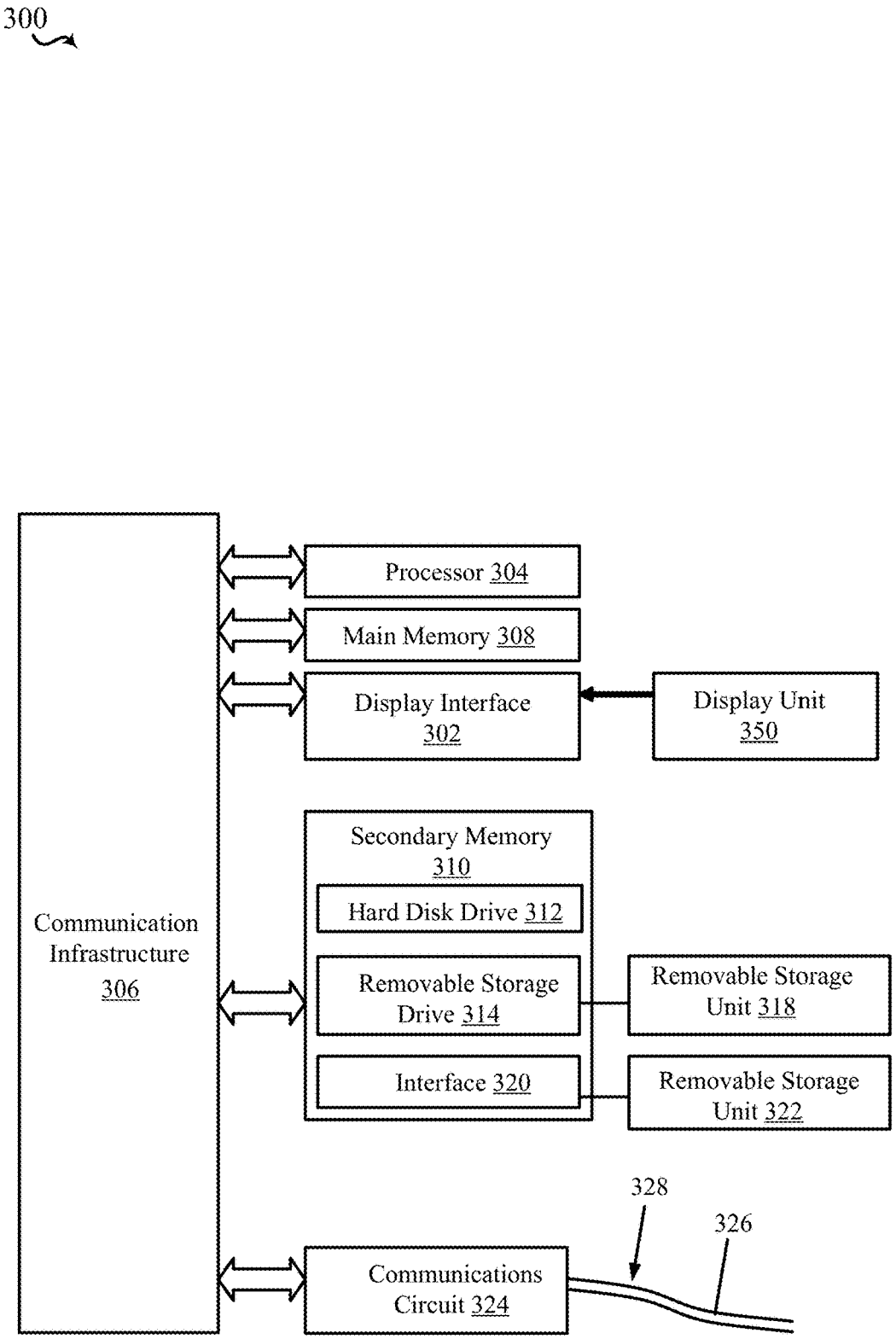
FIG. 3 illustrates an example of a computer system in accordance with aspects of the present disclosure.

Aspects of the present disclosures may be implemented using hardware, software, or a combination thereof and may be implemented in one or more computer systems or other processing systems. In an aspect of the present disclosures, features are directed toward one or more computer systems capable of carrying out the functionality described herein. An example of such the computer system 300 is shown in FIG. 3. In some examples, the reader 110 and/or the cash register 106 may be implemented as the computer system 300 shown in FIG. 3. The reader 110 and/or the cash register 106 may include some or all of the components of the computer system 300.

The computer system 300 includes one or more processors, such as processor 304. The processor 304 is connected with a communication infrastructure 306 (e.g., a communications bus, cross-over bar, or network). Various software aspects are described in terms of this example computer system. After reading this description, it will become apparent to a person skilled in the relevant art(s) how to implement aspects of the disclosures using other computer systems and/or architectures.

The computer system 300 may include a display interface 302 that forwards graphics, text, and other data from the communication infrastructure 306 (or from a frame buffer not shown) for display on a display unit 350. Computer system 300 also includes a main memory 308, preferably random access memory (RAM), and may also include a secondary memory 310. The secondary memory 310 may include, for example, a hard disk drive 312, and/or a removable storage drive 314, representing a floppy disk drive, a magnetic tape drive, an optical disk drive, a universal serial bus (USB) flash drive, etc. The removable storage drive 314 reads from and/or writes to a removable storage unit 318 in a well-known manner. Removable storage unit 318 represents a floppy disk, magnetic tape, optical disk, USB flash drive etc., which is read by and written to removable storage drive 314. As will be appreciated, the removable storage unit 318 includes a computer usable storage medium having stored therein computer software and/or data. In some examples, one or more of the main memory 308, the secondary memory 310, the removable storage unit 318, and/or the removable storage unit 322 may be a non-transitory memory.

Alternative aspects of the present disclosures may include secondary memory 310 and may include other similar devices for allowing computer programs or other instructions to be loaded into computer system 300. Such devices may include, for example, a removable storage unit 322 and an interface 320. Examples of such may include a program cartridge and cartridge interface (such as that found in video game devices), a removable memory chip (such as an erasable programmable read only memory (EPROM), or programmable read only memory (PROM)) and associated socket, and the removable storage unit 322 and the interface 320, which allow software and data to be transferred from the removable storage unit 322 to computer system 300.

Computer system 300 may also include a communications circuit 324. The communications circuit 324 may allow software and data to be transferred between computer system 300 and external devices. Examples of the communications circuit 324 may include a modem, a network interface (such as an Ethernet card), a communications port, a Personal Computer Memory Card International Association (PCMCIA) slot and card, etc. Software and data transferred via the communications circuit 324 are in the form of signals 328, which may be electronic, electromagnetic, optical or other signals capable of being received by the communications circuit 324. These signals 328 are provided to the communications circuit 324 via a communications path (e.g., channel) 326. This path 326 carries signals 328 and may be implemented using wire or cable, fiber optics, a telephone line, a cellular link, an RF link and/or other communications channels. In this document, the terms "computer program medium" and "computer usable medium" are used to refer generally to media such as the removable storage unit 318, a hard disk installed in hard disk drive 312, and signals 328. These computer program products provide software to the computer system 300. Aspects of the present disclosures are directed to such computer program products.

Computer programs (also referred to as computer control logic) are stored in main memory 308 and/or secondary memory 310. Computer programs may also be received via communications circuit 324. Such computer programs, when executed, enable the computer system 300 to perform the features in accordance with aspects of the present disclosures, as discussed herein. In particular, the computer programs, when executed, enable the processor 304 to perform the features in accordance with aspects of the present disclosures. Accordingly, such computer programs represent controllers of the computer system 300.

In an aspect of the present disclosures where the method is implemented using software, the software may be stored in a computer program product and loaded into computer system 300 using removable storage drive 314, hard disk drive 312, or the interface 320. The control logic (software), when executed by the processor 304, causes the processor 304 to perform the functions described herein. In another aspect of the present disclosures, the system is implemented primarily in hardware using, for example, hardware components, such as application specific integrated circuits (ASICs). Implementation of the hardware state machine so as to perform the functions described herein will be apparent to persons skilled in the relevant art(s).

It will be appreciated that various implementations of the above-disclosed and other features and functions, or alternatives or varieties thereof, may be desirably combined into many other different systems or applications. Also that various presently unforeseen or unanticipated alternatives, modifications, variations, or improvements therein may be subsequently made by those skilled in the art which are also intended to be encompassed by the following claims.

What is claimed is:

1. A method of reducing false positive alarms, comprising:
- identifying a first sector proximal to a reader and a second sector proximal to the reader;
- receiving one or more parameters associated with a minimum sector count setting as a minimum consecutive tag read parameter;
- applying, to the reader, the one or more parameters associated with the minimum sector count setting;
- determining whether a tag has moved from the first sector to the second sector based on the one or more parameters; and
- transmitting an alarm signal in response to the tag moving from the first sector to the second sector or refraining from transmitting a false alarm signal in response to the tag not moving.

2. The method of claim 1, wherein: receiving the one or more parameters comprises:
- receiving a first value of a first minimum sector count associated with the first sector, and
- receiving a second value of a second minimum sector count associated with the second sector;
- applying the one or more parameters comprises:
  - setting the first minimum sector count to the first value, and
  - setting the second minimum sector count to the second value; and
- determining whether the tag has moved comprises:
  - detecting the tag in the first sector based on acquiring a first plurality of tag reads indicating the tag is in the first sector, wherein a first number of the first plurality of tag reads is greater than or equal to the first minimum sector count, or
  - detecting the tag in the second sector based on acquiring a second plurality of tag reads indicating the tag is in the second sector, wherein a second number of the second plurality of tag reads is greater than or equal to the second minimum sector count.

3. The method of claim 1, wherein the reader is an electro-magnetic (EM) reader, an acousto-magnetic (AM) reader, a radio frequency identification (RFID) reader, a microwave reader, or a quadrature resonance reader.

4. A non-transitory computer readable medium having instructions stored therein that, when executed by a processor, cause the processor to:
- identify a first sector proximal to a reader and a second sector proximal to the reader;
- receive one or more parameters associated with a minimum sector count setting as a minimum consecutive tag read parameter;
- apply, to the reader, the one or more parameters associated with the minimum sector count setting;
- determine whether a tag has moved from the first sector to the second sector based on the one or more parameters; and
- transmit an alarm signal in response to the tag moving from the first sector to the second sector or refraining from transmitting a false alarm signal in response to the tag not moving.

5. The medium of claim 4, wherein the instructions for receiving the one or more parameters comprises instructions for:
- receiving a first value of a first minimum sector count associated with the first sector, and
- receiving a second value of a second minimum sector count associated with the second sector;
- the instructions for applying the one or more parameters comprises instructions for:
  - setting the first minimum sector count to the first value, and
  - setting the second minimum sector count to the second value; and
- the instructions for determining whether a tag has moved comprises instructions for:

detecting the tag in the first sector based on acquiring a first plurality of tag reads indicating the tag is in the first sector, wherein a first number of the first plurality of tag reads is greater than or equal to the first minimum sector count, or detecting the tag in the second sector based on acquiring a second plurality of tag reads indicating the tag is in the second sector, wherein a second number of the second plurality of tag reads is greater than or equal to the second minimum sector count.

6. The medium of claim 5, wherein the first value is greater than or equal to 2 and the second value is greater than or equal to 2.

7. The medium of claim 4, wherein the reader is an electro-magnetic (EM) reader, an acousto-magnetic (AM) reader, a radio frequency identification (RFID) reader, a microwave reader, or a quadrature resonance reader.

8. A reader for a tag, comprising:

a memory storing instructions; and a processor communicatively coupled to the memory and configured to execute the instructions to:

identify a first sector proximal to the reader and a second sector proximal to the reader;

receive one or more parameters associated with a minimum sector count setting as a minimum consecutive tag read parameter;

apply, to the reader, the one or more parameters associated with the minimum sector count setting;

determine whether a tag has moved from the first sector to the second sector based on the one or more parameters; and transmit an alarm signal in response to the tag moving from the first sector to the second sector or refraining from transmitting a false alarm signal in response to the tag not moving.

9. The reader of claim 8, wherein: receiving the one or more parameters comprises:

receiving a first value of a first minimum sector count associated with the first sector, and receiving a second value of a second minimum sector count associated with the second sector;

applying the one or more parameters comprises:

setting the first minimum sector count to the first value, and setting the second minimum sector count to the second value; and determining whether the tag has moved comprises:

detecting the tag in the first sector based on acquiring a first plurality of tag reads indicating the tag is in the first sector, wherein a first number of the first plurality of tag reads is greater than or equal to the first minimum sector count, or detecting the tag in the second sector based on acquiring a second plurality of tag reads indicating the tag is in the second sector, wherein a second number of the second plurality of tag reads is greater than or equal to the second minimum sector count.

* * * * *